US010766067B2

(12) United States Patent
Argirov et al.

(10) Patent No.: US 10,766,067 B2
(45) Date of Patent: Sep. 8, 2020

(54) DEVICE FOR PRODUCING CAST PARTS, SUCH AS ALUMINUM CASTINGS, IN A PRESSURE METHOD OR LOW-PRESSURE METHOD

(71) Applicant: Foshan Nanhai Superband Mould Co., Ltd., Foshan, Guandong Province (CN)

(72) Inventors: Borislav Argirov, Bretten (DE); Stefan Argirov, Viernheim (DE)

(73) Assignee: Foshan Nanhai Superband Mould Co., Ltd., Foshan, Guangdong Province (CN)

( * ) Notice: Subject to any disclaimer, the term of this patent is extended or adjusted under 35 U.S.C. 154(b) by 0 days.

(21) Appl. No.: 16/082,714

(22) PCT Filed: Mar. 6, 2017

(86) PCT No.: PCT/EP2017/000302
§ 371 (c)(1),
(2) Date: Sep. 6, 2018

(87) PCT Pub. No.: WO2017/153044
PCT Pub. Date: Sep. 14, 2017

(65) Prior Publication Data

US 2019/0084035 A1 Mar. 21, 2019

(30) Foreign Application Priority Data

Mar. 6, 2016 (DE) ..... 10 2016 104 019

(51) Int. Cl.
*B22C 9/06* (2006.01)
*B22C 9/28* (2006.01)
(Continued)

(52) U.S. Cl.
CPC ..... *B22C 9/28* (2013.01); *B22C 9/06* (2013.01); *B22D 17/22* (2013.01); *B22D 18/04* (2013.01); *B22D 25/02* (2013.01)

(58) Field of Classification Search
CPC .. B22C 9/06; B22C 9/28; B22D 17/22; B22D 18/04; B22D 25/02
(Continued)

(56) References Cited

U.S. PATENT DOCUMENTS 4,206,799 A * 6/1980 McDonald ..... B22D 17/2236 164/341
4,840,557 A * 6/1989 Ishimoto et al. ..... B22D 17/12 164/312

OTHER PUBLICATIONS

Int'l Written Opinion of the International Searching Authority dated May 29, 2017 for Int'l Application No. PCT/EP2017/000302.
(Continued)

*Primary Examiner* — Kevin P Kerns
(74) *Attorney, Agent, or Firm* — Panitch Schwarze Belisario & Nadel LLP

(57) ABSTRACT

The invention relates to a device for producing cast parts, in a pressure method using a casting tool (20) which includes movably arranged lateral parts (4) with a base (1) that receives a lower part or a lower mold part (3) and a plate that has an upper part (7) or an upper mold part (5). At least the upper part (7) together with a removal plate (10) and the upper mold part (5) can be moved in the vertical direction (Z) relative to the standing surface of the casting tool (20) using at least one adjusting device (17), and the lateral parts (4) can likewise be moved in the horizontal direction (X) using the adjusting device and/or additional adjusting devices.

10 Claims, 13 Drawing Sheets

(51) Int. Cl.
*B22D 17/22* (2006.01)
*B22D 18/04* (2006.01)
*B22D 25/02* (2006.01)

(58) Field of Classification Search
USPC ..... 164/303, 339, 341, 342, 344, 137
See application file for complete search history.

(56) References Cited

OTHER PUBLICATIONS

Euorpean Examination Report dated Jul. 12, 2019 in European Application No. 17710474.2.

* cited by examiner

DEVICE FOR PRODUCING CAST PARTS, SUCH AS ALUMINUM CASTINGS, IN A PRESSURE METHOD OR LOW-PRESSURE METHOD

CROSS-REFERENCE TO RELATED APPLICATION

This application is a Section 371 of International Application No. PCT/EP2017/000302, filed Mar. 6, 2017, which was published in the German language on Sep. 14, 2017, under International Publication No. WO 2017/153044 A1, which claims priority under 35 U.S.C. § 119(b) to German Application No. 10 2016 104 019.3, filed Mar. 6, 2016, the disclosures of each of which are incorporated herein by reference in their entireties.

TECHNICAL FIELD

The present disclosure relate to a device for producing cast parts, such as aluminum castings, in a pressure method or a low-pressure method using a casting tool, which includes movably arranged side parts, a base receiving a lower part or a lower mold part, and an upper part or a plate having an upper mold part, where at least the upper part, together with a demoulding plate and the upper mold part, can be adjusted in the vertical direction relative to a supporting surface of the casting tool by means of at least one adjusting device, and the side parts can likewise be adjusted in the horizontal direction by means of the adjusting device and/or additional adjusting devices

BACKGROUND

A tool is disclosed in DE 102 34 026 C1 that relates to a device for producing cast parts, such as aluminum castings, in a pressure method or a low-pressure method. The tool includes movably arranged side parts as well as a base receiving a lower part or a lower mold part, and an upper part or a plate having an upper mold part, where at least the upper part, together with a demoulding plate and the upper mold part, can be adjusted in the vertical direction relative to the supporting surface of the casting tool by means of at least one adjusting device, and the side parts may likewise be adjusted in the horizontal direction by means of the adjusting device and/or additional adjusting devices. In such a device, short-time and simultaneous or synchronous movement of adjustable components cannot be realized. Additionally, the production of the known device is complicated and costly.

SUMMARY

The present invention aims to improve and design the device, such that the simultaneous or synchronous movement of the adjustable components can be realized, and no damage to a cast part will occur during demoulding.

This aim is realized according to the invention in that: for demoulding the cast part, at least one adjusting device interacts directly or indirectly with the demoulding plate, and during vertical adjustment, the upper mold part can be adjusted in the vertical direction, and then the side parts can be adjusted in the vertical direction likewise at least via the one adjusting device. As a result, a shorter demoulding time can be realized in a simple and low-cost way, since short-time and simultaneous or synchronous movement of adjustable components can be realized and overall a very space-saving device can be achieved.

For this purpose, it is advantageous that the adjusting device interacts with positive control elements, which cause a continuous or uniform movement of the side parts or the side sliders in the vertical and horizontal directions relative to the supporting surface of the casting tool.

Furthermore, it is advantageous that the positive control elements are sliding surfaces. Due to the shorter demoulding time, the production cost of the cast part can be reduced. With the aid of the demoulding of the invention, a simpler process for producing the cast part can be realized. The positive control apparatus can be realized by means of a plurality of sliding surfaces, so that during demoulding, the side parts move downward uniformly in direction Z, and the side parts will not swing back and forth. Therefore, the surface of the cast part will not be damaged during demoulding.

It is also advantageous that every two or more sliding surfaces interacts with each other for demoulding the cast part. As a result, during casting, the cast part enclosed by the lateral sliders moves upward along with the upper part after being cooled and then is demoulded from the upper part. By lowering and lateral continuous retraction of the side sliders, the cast part can be removed without damaging especially, in particular the surface of the cast part, is placed downward on a transportation board and moved away laterally. By demoulding according to the invention, no defect will be caused on the front side of the cast part either.

By the simultaneous kinematics of a single part in combination with a plurality of sliding surfaces, the cast part can be detached from the upper tool or the upper part very quickly and uniformly, thereby realizing uniform and intact demoulding.

It is advantageous that the casting tool is configured with five sliding surface pairs.

It is particularly important to the invention that, a first sliding surface pair extending horizontally is consisted of a horizontal first sliding surface arranged on the demoulding plate and a second sliding surface horizontally arranged on a first sliding element or a T-shaped rod; a second sliding surface pair extending in an inclined direction is consisted of a third sliding surface arranged on the first sliding element and a fourth sliding surface arranged on the demoulding plate; a third sliding surface pair extending in an inclined direction is consisted of a fifth sliding surface arranged on the first sliding element or T-shaped rod and a sixth sliding surface arranged on a sliding element or a tilting rod; wherein, a fourth sliding surface pair extending horizontally is consisted of a seventh sliding surface arranged on the first sliding element or the T-shaped rod and an eighth sliding surface arranged on the upper part; the casting tool is further configured with a fifth sliding surface pair extending at an angle of 45° is consisted of a ninth sliding surface arranged on the first sliding element or the T-shaped rod and a tenth sliding surface arranged on the upper part.

It is also advantageous that, the plate or the upper part and the second sliding element or the tilting rod may be firmly connected with each other and connected to the casting tool, wherein when the demoulding plate is directly or indirectly pressed against the sliding element or the T-shaped rod, with the interaction between the fifth and the sixth sliding surfaces of the second sliding element or the tilting rod and the T-shaped rod, between the third and the fourth sliding surfaces, and between the ninth and the tenth sliding surfaces as well as between other horizontally-extending sliding surfaces, the first sliding element is moved outward, such that the third and the fourth sliding surfaces of the first sliding element or the T-shaped rod and the demoulding plate rest on each other, and when the adjusting device further moves downward in the vertical direction, the side part or the lateral slider is forced and guided to move downward and outward on an inclined plane.

Furthermore, it is advantageous that, the first sliding element is a T-shaped rod which is consisted of a horizontal part and a vertically-arranged connecting piece. An opening is provided in the connecting piece to receive a fixing element, and the fixing element is connected to the side part by means of the opening.

It is also advantageous that, the second sliding element or the tilting rod and the upper part are firmly connected to each other via a fixing element and are connected to the casting tool in a vertically adjustable manner, where the connecting piece arranged on the first sliding element is received in the elongated opening arranged on the upper part, and the side parts or the lateral sliders are allowed to be laterally adjusted.

Additionally, it is advantageous that, the first sliding element is a T-shaped rod which has a fifth sliding surface and a third sliding surface arrange reversely at an angle of 45°, the fifth sliding surface and the third sliding surface are both arranged in an end region of the horizontal part, where a recess with three sliding surfaces is arranged on a lower side of the first sliding element, and the second sliding element is received in the recess such that the first sliding element in the side part can be laterally adjusted, thus the third and the fourth sliding surfaces can come to abut and the side parts can be adjusted downward in the vertical direction and outward in the horizontal direction, and the demoulding plate has on its outer circumference a plurality of sliding surfaces, which abut against sliding surface of the first sliding element.

Furthermore, it is advantageous that, the side parts are consisted of at least two or more side part segments, and the side part segments are consecutively fed toward a center or a vertical longitudinal axis direction via an inclined and cooperative sliding rod or moving rod to close the casting tool; and the sliding surfaces of the second sliding element and the first sliding element or the T-shaped rod abut against each other and extend inclinedly, and the sliding surfaces on the first sliding element or the T-shaped rod are arranged horizontally, such that they upon the adjustment of the demoulding plate, enable the first sliding element or the T-shaped rod to move outward in the vertical direction. Thereby, the large production cost of the cast part can be reduced overall since the movable parts can be detached simply and rapidly or continuously. Therefore, a shorter down time of the whole device may be realized, and thus the cost can be saved significantly. With the aid of the advantageously constructed synchronous kinematics and by using only one adjusting device, such as in the form of only one adjusting cylinder, the machine cost can be further lowered.

BRIEF DESCRIPTION OF THE DRAWINGS

Other advantages and details of the invention will be illustrated in the claims and embodiments of the invention and be shown in the drawings:

Wherein.

DETAILED DESCRIPTION

Figure 1:
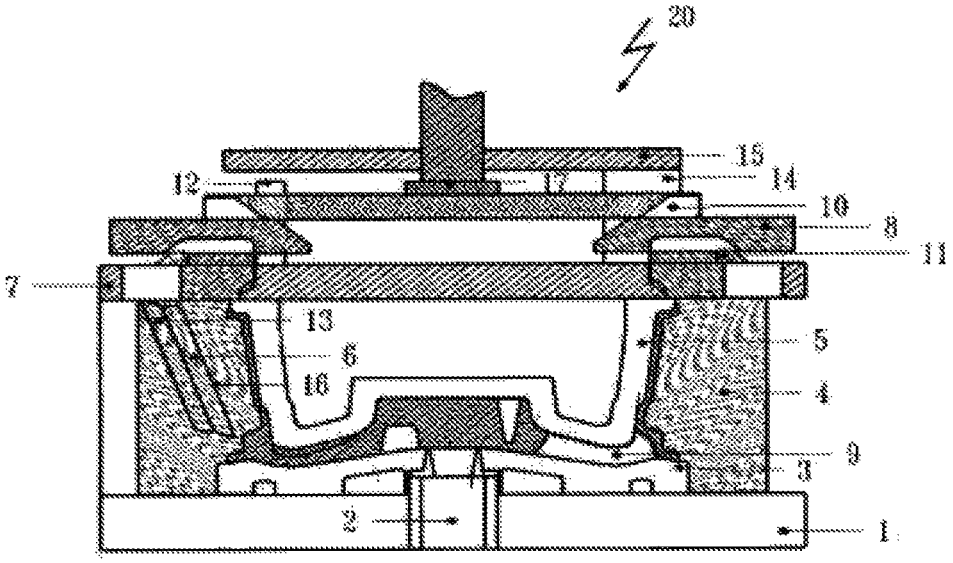
FIG. 1 shows an initial position of a casting tool before demoulding and thus at a closed position of side parts together with a mold and a cast part.

In FIG. 1, a casting tool is denoted by 20 and is configured for a device for producing a cast part 9, such as an aluminum casting, in a pressure method or a low-pressure method, where the process pressure for the device described later can be about 1 bar or even slightly higher.

The casting tool 20 includes a plurality of movably arranged side parts 4 together with a base 1 receiving a lower part or a lower mold part 3, and an upper part 7 or a plate having an upper mold part 5. At least the upper part 7 is connected to a cover plate 15 of the device via a spacing column 14. A demoulding plate 10 is connected to the upper mold part 5 of the device and adjusted in the vertical direction Z relative to a supporting surface of the casting tool 20 by means of at least one adjusting device 17, and the side part 4 can likewise be adjusted in the horizontal direction X by means of the adjusting device and/or another adjusting device.

To demould the cast part 9, at least one adjusting device 17 directly or indirectly interacts with the demoulding plate 10. During the vertical adjustment of the adjusting device 17, the upper mold part 5 is adjusted in the vertical direction Z, and then the side part 4 is adjusted likewise in the horizontal direction X at least via one adjusting device 17.

The adjusting device 17 interacts with positive control elements, and the positive control elements make the side parts or the side sliders 4 move continuously or uniformly in the vertical and horizontal directions relative to the supporting surface of the casting tool.

The positive control elements are formed as sliding surfaces 18*a*, 18*b*, 19*a*, 19*b*, 50*a*, 50*b*, 60*a*, 60*b*, 70*a* and 70*b*. To demould the cast part 9, every two or more of 18*a*, 18*b*, 19*a*, 19*b*, 50*a*, 50*b*, 60*a*, 60*b*, 70*a* and 70*b* interact with each other. The device or the casting tool 20 is configured with five sliding surface pairs.

A fifth sliding surface pair 18*a*, 18*b* extending at an angle of 45° is consisted of a ninth sliding surface 18*a* arranged on a first sliding element or a T-shaped rod 8 and a tenth sliding surface 18*b* arranged on the upper part 7.

A third sliding surface pair 19*a*, 19*b* extending at an angle of 45° is consisted of a fifth sliding surface 19*a* arranged on the first sliding element or the T-shaped rod 8 and a sixth sliding surface 19*b* arranged on a sliding element or a tilting rod 11.

A second sliding surface pair 50*a*, 50*b* extending at an angle of 45° is consisted of a third sliding surface 50*a* arranged on the first sliding element 8 and a fourth sliding surface 50*b* arranged on the demoulding plate 10.

A first sliding surface pair 60*a*, 60*b* extending horizontally is consisted of a first horizontal sliding surface 60*a* arranged on the demoulding plate 10 and a second sliding surface 60*b* horizontally arranged on the first sliding element or the T-shaped rod 8.

A fourth sliding surface pair 70*a*, 70*b* extending horizontally is consisted of a seventh sliding surface 70*a* arranged on the first sliding element or the T-shaped rod 8 and an eighth sliding surface 70*b* arranged on the upper part 7.

Figure 5A:
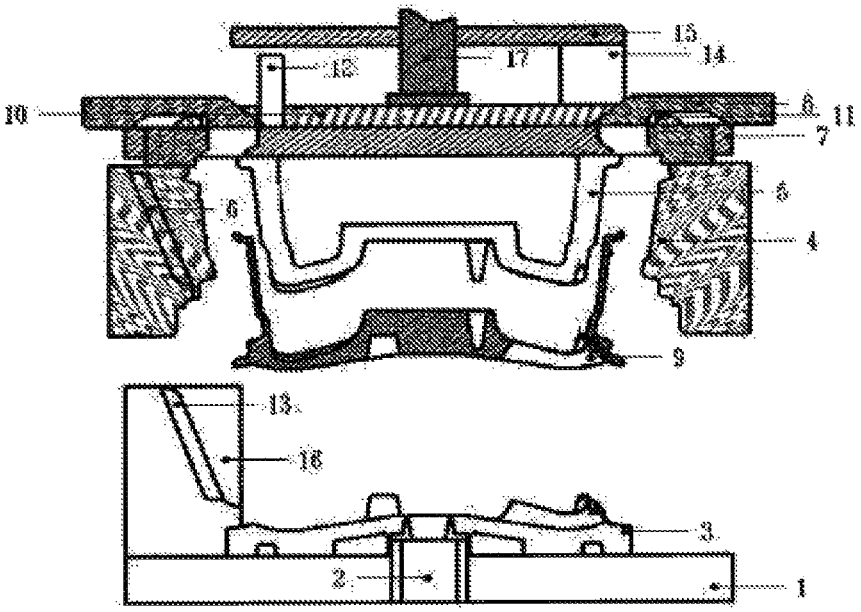
FIG. 5*a* shows a third demoulding stage, a common vertical movement of the demoulding plate downward in direction Z and a simultaneous movement of the side sliders and the T-shaped rod outward in direction X, where the third sliding surface abuts against the fourth sliding surface.
Figure 5B:
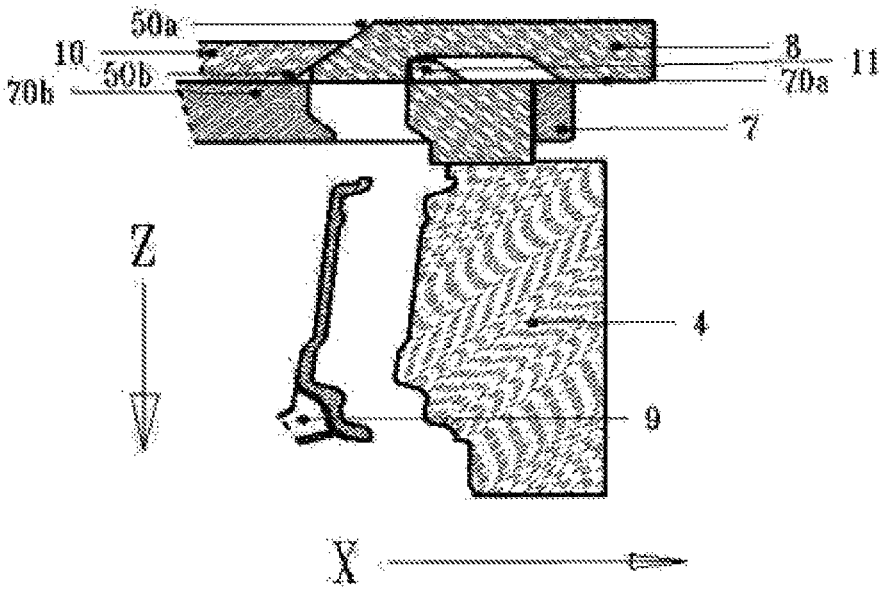
FIG. 5*b* shows a partial view of the casting tool according to FIG. 5*a;*
Figure 5C:
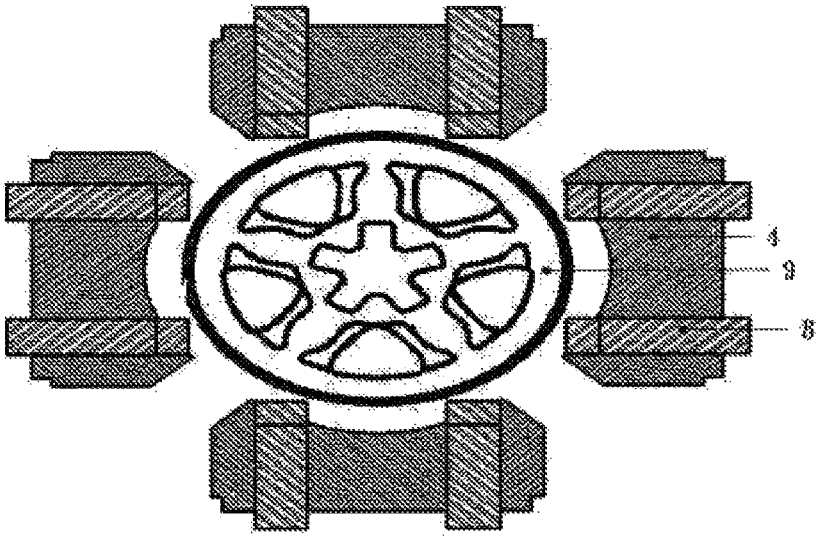
FIG. 5*c* shows a top view of the casting tool according to FIG. 5*a;*

The upper part 7 and the second sliding element or the tilting rod 11 are firmly connected to each other via a fixing element and firmly connected to the casting tool 20, thus are unadjustable in the vertical direction. The casting tool 20 has an opening 25, in which the cast part is shaped (FIG. 5*c*).

Figure 6:
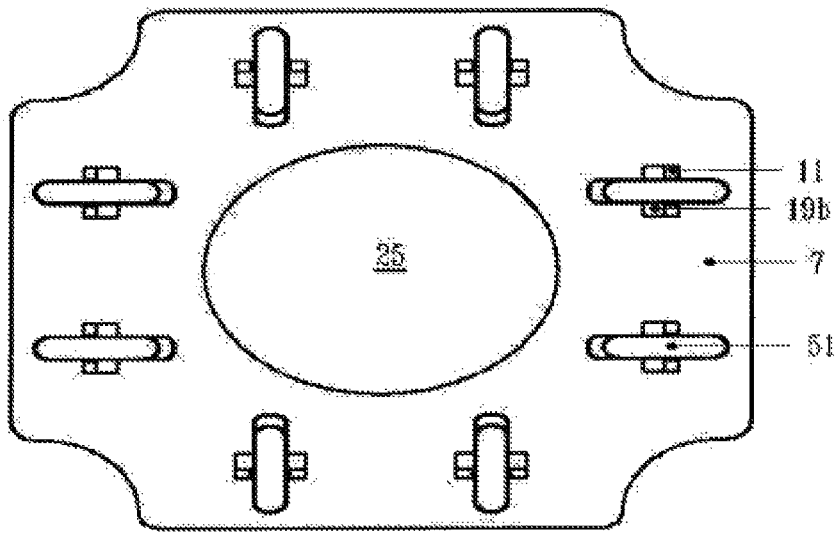
FIG. 6 shows a plate or an upper part.
Figure 7:
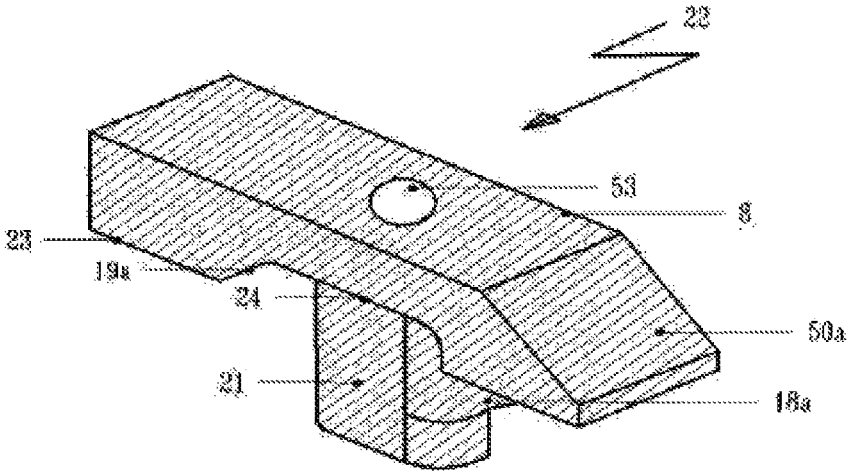
FIG. 7 shows a 3D view of a T-shaped rod.
Figure 8:
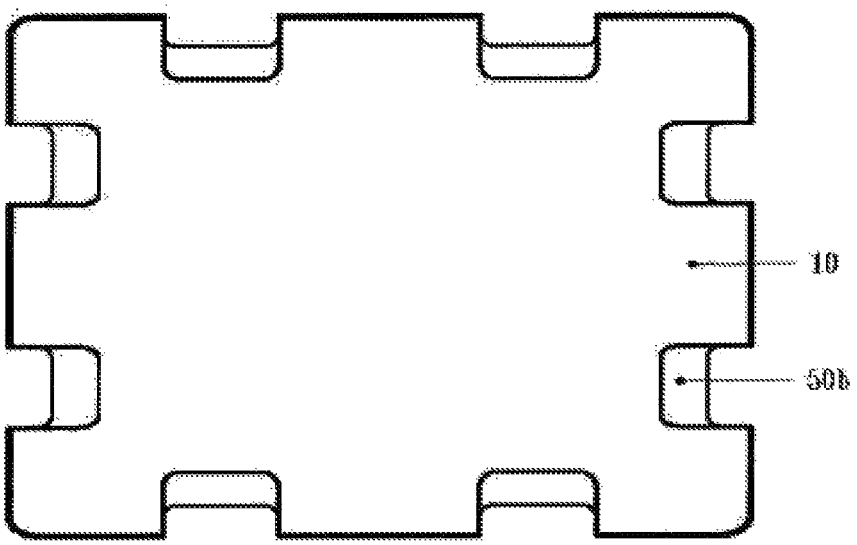
FIG. 8 shows a lower part of the demoulding plate.
Figure 9:
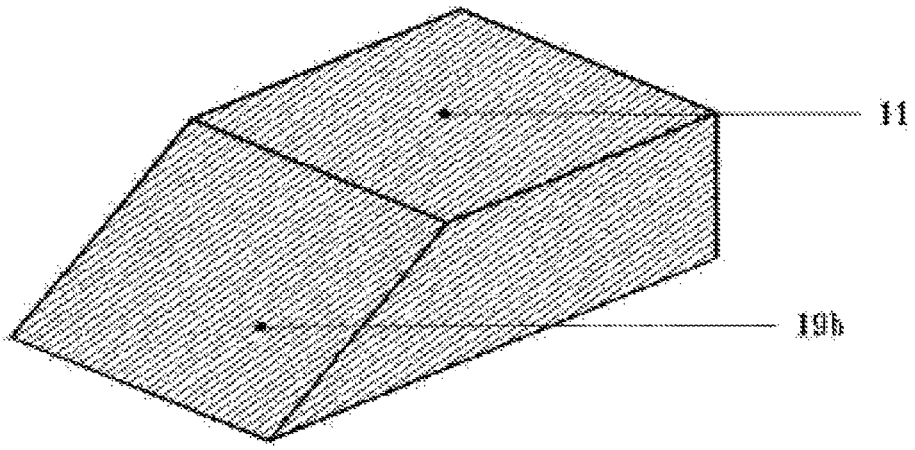
FIG. 9 shows a 3D view of a second sliding element or a tilting rod.

The first sliding element 8 according to FIG. 7 has a vertical connecting piece 21 and is connected to the side part 4 by means of a fixing element or a bolt that is not shown. The bolt extends into the side part 4 through a borehole 53 arranged in the T-shaped rod 8 and an elongated opening 51 arranged on the upper part 7 (FIG. 6).

Figure 4A:
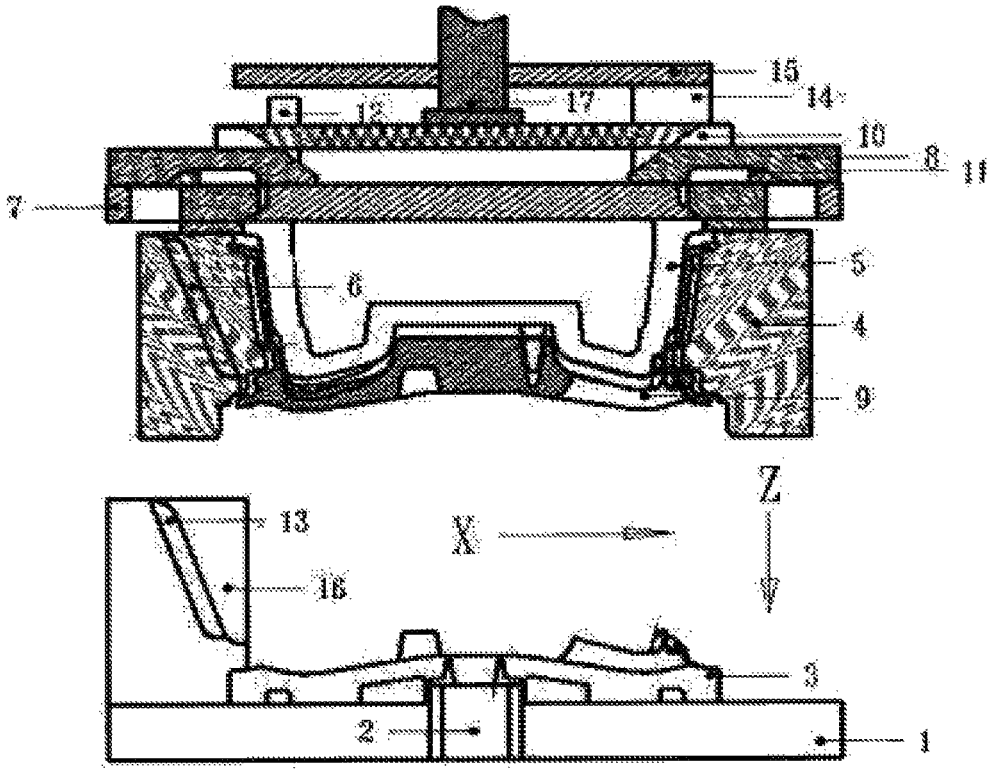
FIG. 4*a* shows a second demoulding stage, a common vertical movement stage of the demoulding plate downward in direction Z, and a simultaneous movement of the side sliders and the T-shaped rod vertically outward in direction X, where the two upper sliding surfaces extend on the same plane.
Figure 4B:
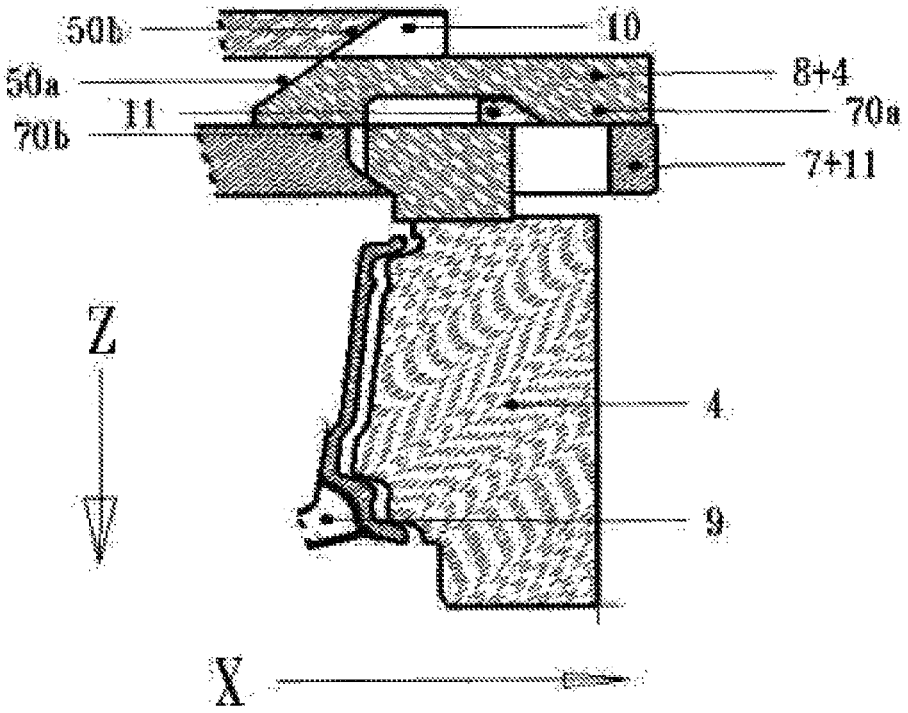
FIG. 4*b* shows a partial view of the casting tool according to FIG. 4*a;*
Figure 4C:
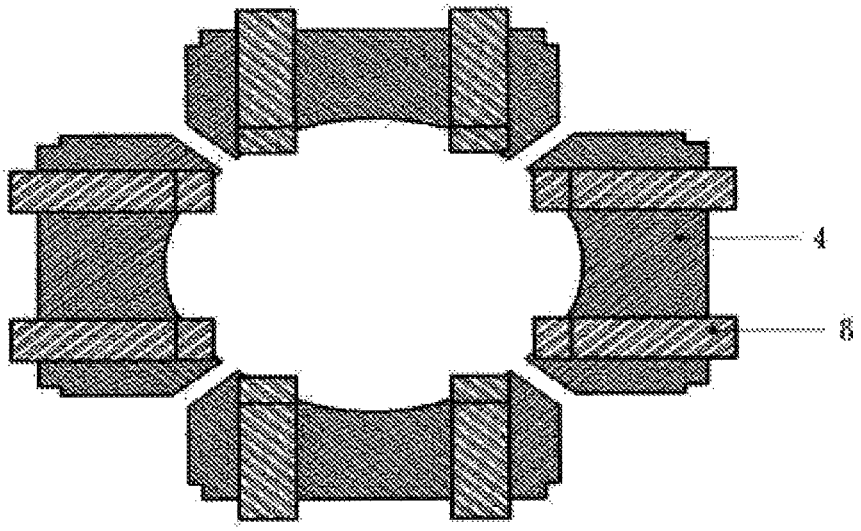
FIG. 4*c* shows a top view of the casting tool according to FIG. 4*a;*

Since the plate or the upper part 7 and the second sliding element or the tilting rod 11 are firmly connected to each other and are directly or indirectly connected to the casting tool 20, when the demoulding plate 10 directly or indirectly abuts against the first sliding element or the T-shaped rod 8 and thus indirectly acts on the side part 4, the T-shaped rod 8, together with the side part 4, moves outward in the direction X according to FIG. 4*b*, such that the sliding surfaces 50*a* and 50*b* extend on an inclined plane at an angle of 45° relative to the supporting surface of the device. At the position of FIG. 4*b*, when the plate or the demoulding plate 10 is further adjusted along direction Z, the sliding surface 50*b* abuts against the sliding surface 50*a*, thereby the T-shaped rod 8 and the side part 4 move on an inclined plane along direction Z-X, as the sliding surfaces 18*a*, 18*b* and 19*a*, 19*b* will further slidably contact with each other in this movement. In this adjusting process, the side part 4 moves continuously from cast part 9 during the continuous adjustment from FIG. 4*b* to FIG. 5*b*, and thus is ultimately fully released, such that the east part is delivered downward to a transportation plate in direction Z, and can move out from the device laterally.

Since the first sliding element is formed as a T-shaped rod 8 and is consisted of a horizontal part and the vertically-arranged connecting piece 21, in which the opening 53 is provided for receiving the fixing element not shown in the drawings, an in the connecting piece, the connecting piece 21 and the horizontally extending part 22 and thus the sliding element 8 can be firmly connected to the side part 4. The T-shaped rod 8 and the side part 4 are therefore adjusted together in the direction Z and the direction X.

The demoulding plate 10 has on the outer circumference a plurality of, in particular 8, sliding surfaces 50*b* which abut against the sliding surface 50*a* of the first sliding unit 8.

Figure 10:
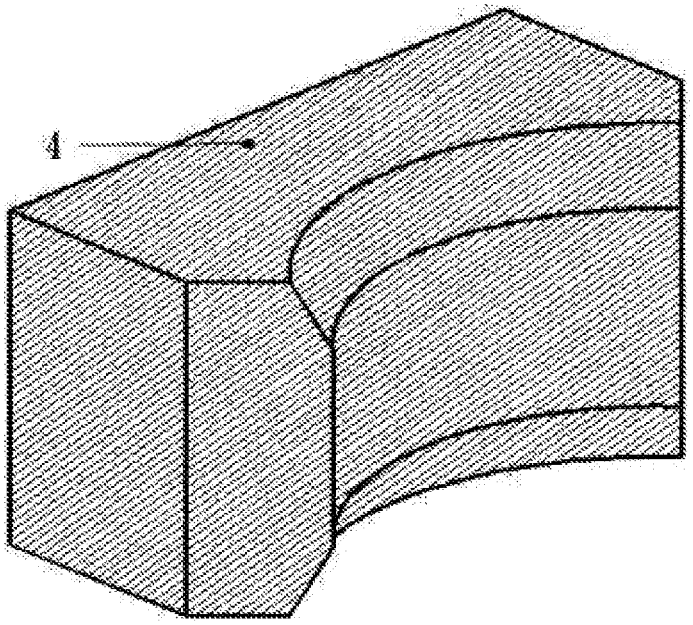
FIG. 10 shows a partial view via a 3D view of one of the four adjustable side sliders.
Figure 11:
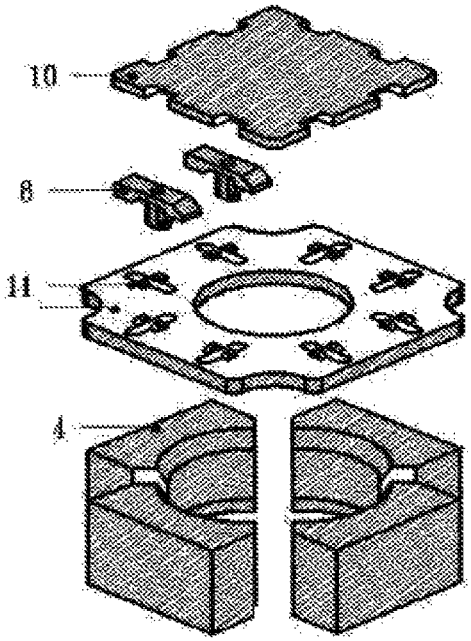
FIG. 11 shows an exploded view of the casting tool.

According to FIG. 5*c* and FIG. 10, the side part 4 is consisted of at least two, in particular four, side part segments, which are consecutively fed toward the center or the vertical longitudinal axis via inclined and cooperative sliding rods or moving rods 6, 13 arranged on a corner part 16 of the base 1 and on the side part 4 so as to close the casting tool 20 again after demoulding, so that the casting tool can be again filled with melts via a sprue bush at a low pressure of about 1 bar to 5 bar. According to FIG. 19, the side part has a die face with an inwardly directed concave surface, which determines the outer surface of the cast part 9.

Figure 2A:
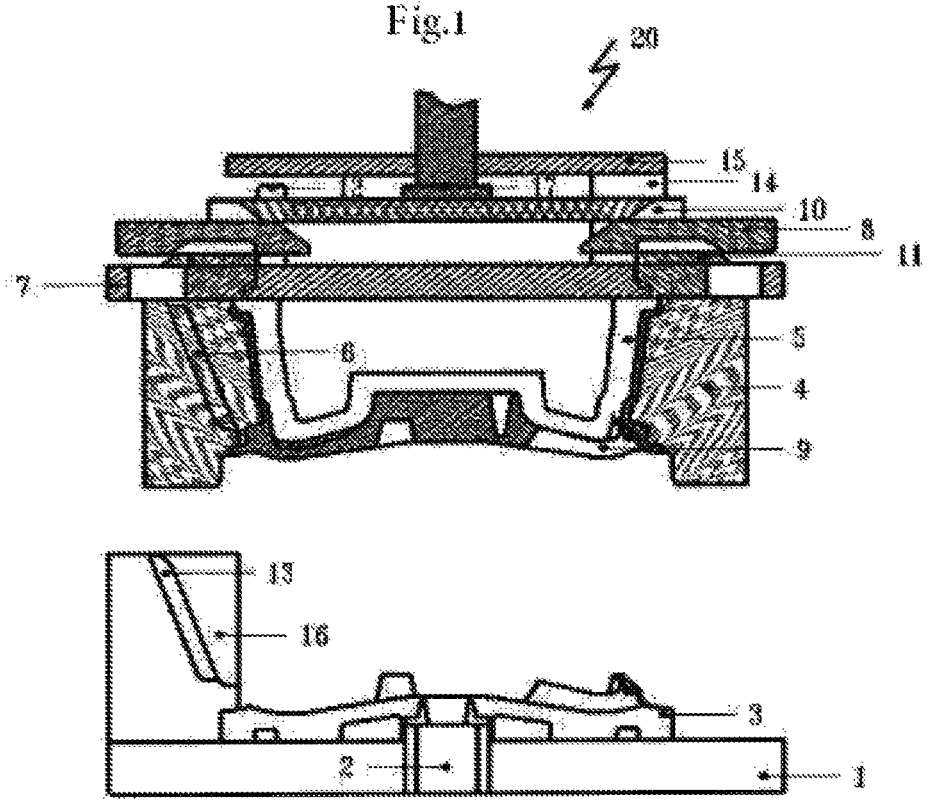
FIG. 2*a* shows a vertical opening of the casting tool in direction Z and thus the start of a demoulding stage.
Figure 2B:
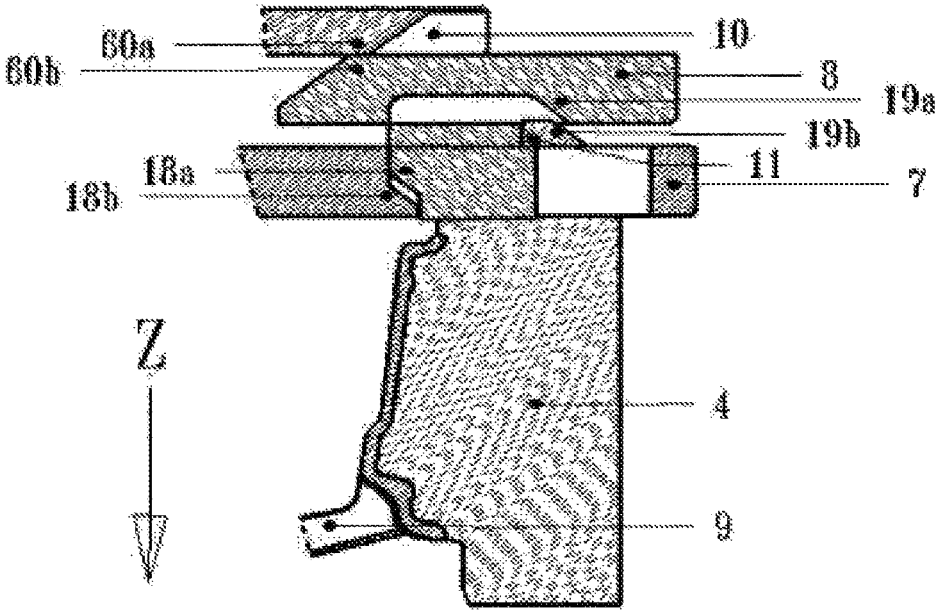
FIG. 2*b* shows a partial view of the example according to FIG. 2*a;*
Figure 3A:
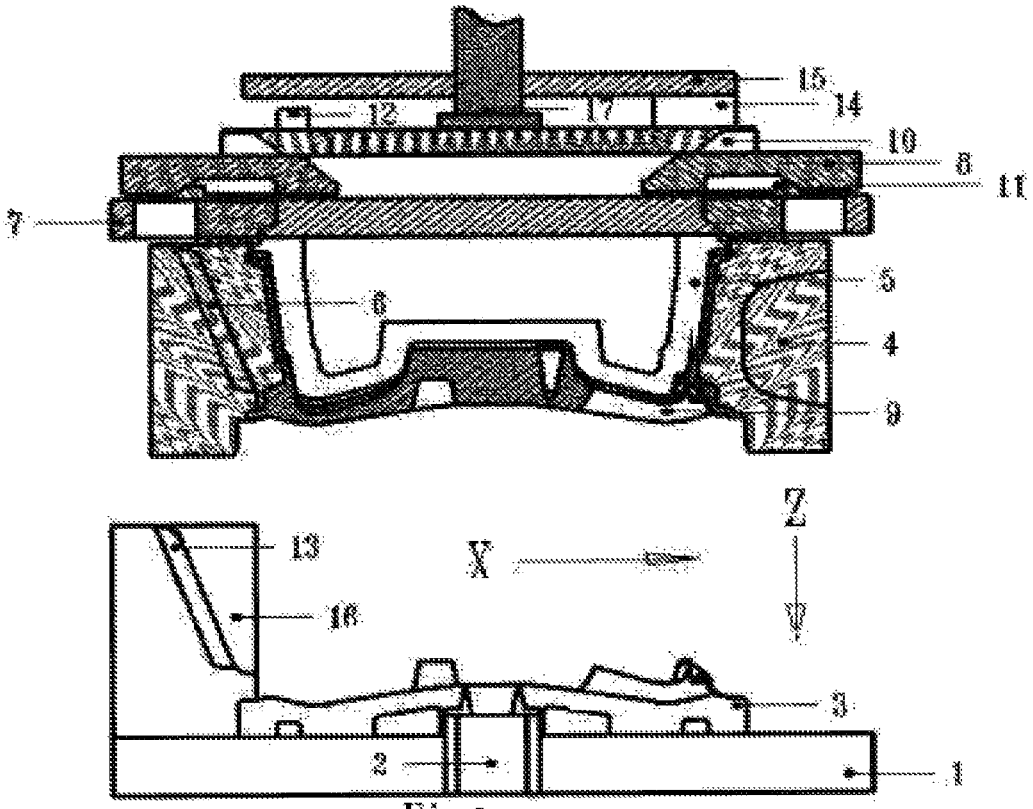
FIG. 3*a* shows a first demoulding stage, a common vertical movement stage of a demoulding plate, a T-shaped rod and side sliders in direction Z, and a simultaneous movement of the T-shaped rod 8 and the side sliders 4 in direction X.
Figure 3B:
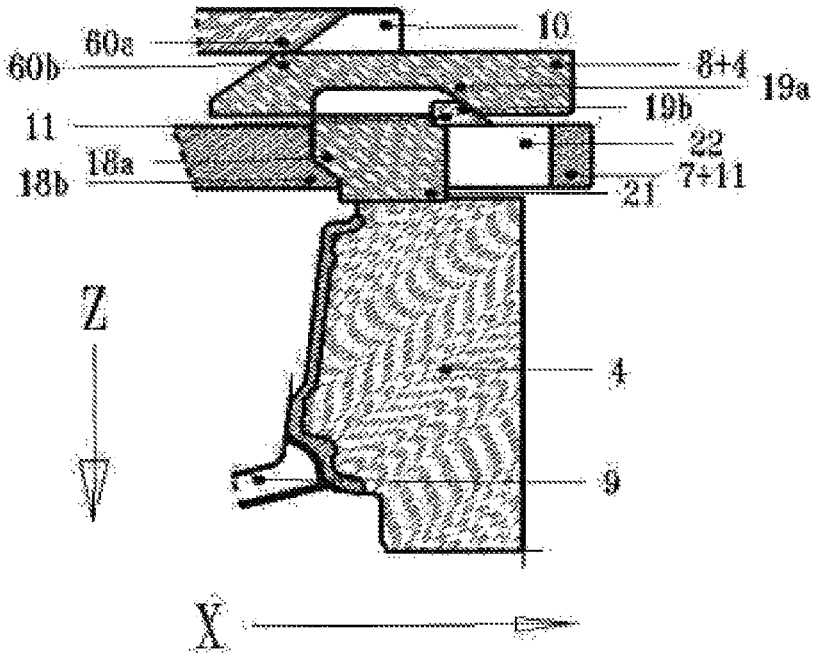
FIG. 3*b* shows a partial view of the casting tool according to FIG. 3*a;*
Figure 3C:
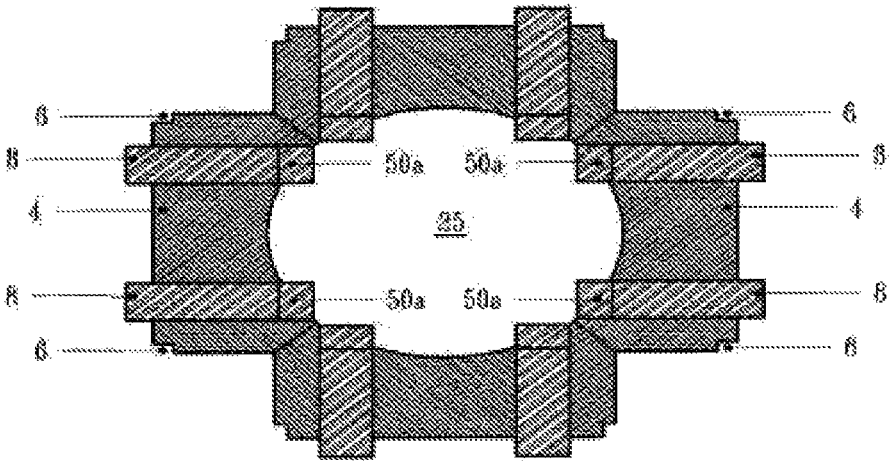
FIG. 3*c* shows a top view of the casting tool according to FIG. 3*a;*

The function of the sliding surface will be summarized below: FIG. 2*b* shows the function of the sliding surface and the movement direction of the sliding surface 60*a*+60*b* opposite to direction X. The adjustment path is effected via the abutment of the sliding surfaces 19*a*, 19*b*, since the parts 7 and 11 cannot move laterally during the adjustment of the part or the demoulding plate 10, instead, only the first sliding element 8 can be adjusted in direction X. In the adjustment process of FIG. 2*b* to FIG. 3*b*, the sliding surface 18*a*, 18*b* and 19*a*, 19*b* come to abut, thereby effecting the adjustment of the T-shaped rod 8 and the side part 4 from FIG. 3*b* to FIG. 4*b*. The distance between the cast part 9 and the side part 4 is increased continuously. With the aid of the abutment of the sliding surfaces 18*a*, 18*b*, 19*a*, 19*b*, 60*a*, 60*b*, the movement of the T-shaped rod 8 and the side part 4 in direction Z and direction X, i.e., the movement on an inclined plane, is affected in further adjustment, thus the downward movement according to FIG. 4*b* and FIG. 5*b* is affected. Here, the sliding surfaces 50*a*, 50*b*, 70*a* and 70*b* interact with each other.

REFERENCE NUMBERS IN THE DRAWINGS

1 Base
2 Sprue Bush
3 Lower Part, Lower Mold Part
4 Side part, Side Slider
5 Upper Part, Upper Mold Part
6 Sliding Rod, Moving Rod
7 Plate, Upper Part
8 First Sliding Element, T-Shaped Rod
9 Cast Part
10 Plate, Demoulding Plate
11 Second Sliding Element, Tilting Rod
12 Guiding Column
13 Sliding Rod, Moving Rod
14 Spacing Column
15 Cover Plate
16 Corner Part
17 Adjusting Device, Hydraulic Cylinder
18*a* Ninth Sliding Surface On Part 8
18*b* Tenth Sliding Surface On Part 7
19*a* Fifth Sliding Surface On Part 8
19*b* Sixth Sliding Surface On Part 11
20 Casting Tool
21 Connecting Piece
22 Horizontal Part
23 Lower Side

24 Recess
25 First Opening
50*a* Third Sliding Surface On Part 8
50*b* Fourth Sliding Surface On Part 10
51 Elongated Opening
53 Second Opening, Hole
60*a* First Sliding Surface On Part 10
60*b* Second Sliding Surface On Part 8
70*a* Seventh Sliding Surface On Part 8
70*b* Eighth Sliding Surface On Part 7
X Horizontal Direction
Z Vertical Direction

What is claimed is:

1. A device for producing a cast part (9) in a pressure method or a low-pressure method by means of a casting tool (20) which comprises movably arranged side parts (4), a base (1) receiving a lower part or a lower mold part (3), and an upper part (7) or a plate having an upper mold part (5), wherein at least the upper part (7), together with a demoulding plate (10) and the upper mold part (5), is adjustable in a vertical direction (Z) relative to a supporting surface of the casting tool (20) by means of at least one adjusting device (17), and the side parts (4) are also adjustable in a horizontal direction (X) by means of at least one adjusting device and/or an additional adjusting device;

wherein, at least one of the at least one adjusting device (17) is configured to interact directly or indirectly with the demoulding plate (10) to demould the cast part (9), and during the vertical adjustment, the upper mold part (5) is adjustable in the vertical direction (Z), and then the side parts (4) are adjustable in the horizontal direction (X) at least via the at least one adjusting device (17), the at least one adjusting device (17) is configured to interact with positive control elements, which cause a continuous or uniform movement of the side parts (4) in an inclined direction relative to the supporting surface of the casting tool, the positive control elements are constructed as sliding surfaces (19*a*, 19*b*, 50*a*, 50*b*, 60*a*, 60*b*, 70*a*, 70*b*), the casting tool (20) is configured with a plurality of sliding surface pairs, characterized by that a first sliding surface pair (60*a*, 60*b*) extending horizontally is consisted of a horizontal first sliding surface (60*a*) arranged on the demoulding plate (10) and a second sliding surface (60*b*) horizontally arranged on a first sliding element (8);

a second sliding surface pair (50*a*, 50*b*) extending in an inclined direction is consisted of a third sliding surface (50*a*) arranged on the first sliding element (8) and a fourth sliding surface (50*b*) arranged on the demoulding plate (10);

a third sliding surface pair (19*a*, 19*b*) extending in an inclined direction is consisted of a fifth sliding surface (19*a*) arranged on the first sliding element (8) and a sixth sliding surface (19*b*) arranged on a second sliding element (11);

wherein, a fourth sliding surface pair (70*a*, 70*b*) extending horizontally is consisted of a seventh sliding surface (70*a*) arranged on the first sliding element (8) and an eighth sliding surface (70*b*) arranged on the upper part (7).

2. The device according to claim 1, wherein, the casting tool (20) is further configured with a fifth sliding surface pair (18*a*, 18*b*) extending at an angle of 45° is consisted of a ninth sliding surface (18*a*) arranged on the first sliding element (8) and a tenth sliding surface (18*b*) arranged on the upper part (7).

3. The device according to claim 2, wherein, the plate or the upper part (7) and the second sliding element (11) are firmly connected to each other and connected to the casting tool (20), wherein when the demoulding plate (10) is directly or indirectly pressed against the first sliding element (8), with the interaction between the fifth and the sixth sliding surfaces (19*a*, 19*b*) of the second sliding element (11) and the first sliding element (8), between the third and the fourth sliding surfaces (50*a*, 50*b*), and between the ninth and the tenth sliding surfaces (18*a*, 18*b*) as well as between other horizontally-extending sliding surfaces (70*a*, 70*b*), the first sliding element (8) is moved outward, such that the third and the fourth sliding surfaces (50*a*, 50*b*) of the first sliding element (8) and the demoulding plate (10) abut against each other, and when the adjusting device (17) further moves downward in the vertical direction (Z), the side parts (4) are forced and guided to move downward and outward on an inclined plane (X, Z).

4. The device according to claim 2, wherein, the first sliding element (8) is constructed as a T-shaped rod which comprises a horizontal part (22) and a vertically-arranged connecting piece (21) in which an opening (53) is arranged to receive a fixing element, wherein the fixing element is connected to one of the side parts (4) by means of the opening.

5. The device according to claim 4, wherein, the second sliding element (11) and the upper part (7) are firmly connected to each other via a fixing element and are connected to the casting tool (20) in a vertically adjustable manner, wherein the connecting piece (21) arranged on the first sliding element (8) is received in an elongated opening (51) arranged on the upper part (7), to allow for lateral adjustment of the side parts (4).

6. The device according to claim 4, wherein, the T-shaped rod has a ninth sliding surface and a third sliding surface (18*a*, 50*a*) arranged reversely at an angle of 45°, the ninth sliding surface and the third sliding surface are arranged in one end region of the horizontal part (22), wherein a recess (24) with the fifth sliding surface (19*a*) is arranged on a lower side (23) of the first sliding element (8), and the second sliding element (11) is received in the recess to allow for lateral adjustment of the first sliding element (8) in one of the side parts (4), so that the third and the fourth sliding surfaces (50*a*, 50*b*) abut against each other, and the side parts (4) are adjustable downward in the vertical direction (Z) and adjustable outward in the horizontal direction (X).

7. The device according to claim 2, wherein, the demoulding plate (10) has on its outer circumference a plurality of the fourth sliding surfaces (50*b*) which abut against the third sliding surface (50*a*) of the first sliding element (8).

8. The device according to claim 2, wherein, the sliding surface (19*a*, 19*b*) of the second sliding element (11) and the first sliding element (8) abut against each other and extend inclinedly, and the seventh and the eighth sliding surfaces (70*a*, 70*b*) on the first sliding element (8) and the upper part (7) are horizontally arranged, so that sliding surfaces upon the adjustment of the demoulding plate (10) in the vertical direction (Z), enable the first sliding element or the T-shaped rod (8) to move outward in the horizontal direction (X).

9. The device according to claim 1, wherein, the side parts (4) are consisted of at least two or more side part segments, and the side part segments are consecutively moved toward a center or a vertical longitudinal axis via inclined and cooperative sliding rods or moving rods (6, 13) to close the casting tool (20).

10. The device according to claim 1, wherein, the side parts (4) each are provided with one first sliding element (8) on each of opposite sides.

* * * * *